United States Patent [19]

Cohen

[11] 4,293,323

[45] Oct. 6, 1981

[54] WASTE HEAT ENERGY RECOVERY SYSTEM

[76] Inventor: Frederick Cohen, 1500 W. Church St., Orlando, Fla. 32805

[21] Appl. No.: 71,363

[22] Filed: Aug. 30, 1979

[51] Int. Cl.[3] ..... F25B 27/02; F25B 13/00

[52] U.S. Cl. ..... 62/238.6; 62/324.5; 165/142

[58] Field of Search ..... 62/238 E, 238.6, 324 D, 62/324.5; 165/142

[56] References Cited

U.S. PATENT DOCUMENTS

| | | | |
|---|---|---|---|
| 683,278 | 9/1901 | Higbee | 165/142 |
| 2,351,230 | 6/1944 | Powell | 165/142 X |
| 2,375,157 | 5/1945 | Wilkes et al. | 62/238 E |
| 2,376,373 | 5/1945 | Merckel | 62/396 |
| 2,669,435 | 2/1954 | Cord et al. | 165/142 X |
| 3,188,829 | 6/1965 | Siewert et al. | 62/324 D |
| 4,168,745 | 9/1979 | Lastinger | 62/238 E |

*Primary Examiner*—Lloyd L. King

*Attorney, Agent, or Firm*—Duckworth, Hobby, Allen, Dyer & Pettis

[57] ABSTRACT

A heat exchange element is inserted directly into a water heater storage tank of a new or existing water heating system. The heat exchange element is provided with standard pipe thread connections and adapted to be installed in standard threaded openings in conventional tanks. The heat exchange element is an elongate outer tube inserted vertically through the top of the tank having the bottom end of the tube closed, and a concentric inner tube open at the bottom end. The inner tube is connected to the output of a refrigeration or air conditioning system compressor to receive the superheated refrigerant gas. The outer tube is connected to the condenser of the system. The heat from the refrigerant is transferred to the water in the storage tank thereby utilizing energy otherwise wasted. A tempering valve is used with the water storage tank to limit hot water output to a desired temperature.

6 Claims, 7 Drawing Figures

WASTE HEAT ENERGY RECOVERY SYSTEM

BACKGROUND OF THE INVENTION

1. Field of the Invention

The present invention relates to a system for using waste energy to heat water, and in particular a system in which the waste heat in air conditioning and refrigeration systems may be used in conjunction with existing hot water systems without modification thereto.

2. Description of the Prior Art

The use of waste heat from refrigeration apparatus to heat water is well known and many teachings in the prior art have shown systems and apparatus for this purpose. For example, the following U.S. Patents are illustrative of this general principle: U.S. Pat. No. 3,922,876 to Wetherington, Jr. et al; U.S. Pat. No. 2,562,651 to Whitney; U.S. Pat. No. 2,125,842 to Eggleston and U.S. Pat. No. 1,922,132 to Holmes.

Many of the prior art systems provide a heat exchanger between the refrigeration system compressor and condenser. The water from a storage tank is circulated, generally by a pump, through the heat exchanger, picking up heat from the superheated refrigerant line. Various temperature valves, temperature switches, thermostats and the like are necessary to prevent excess heating of the water and to protect the system from freezing temperatures when the heat exchanger is located outside, resulting in extra cost for such apparatus and the maintenance thereof.

SUMMARY OF THE INVENTION

The present invention includes a heat exchange element which is adapted to be inserted directly into a conventional water heater storage tank of a new or existing system having a primary heating means such as electricity, gas, or oil. Advantageously, the heat exchange element is provided with a pipe thread connection which may be threaded into one of the usual threaded openings of a water heater storage tank. The heat exchange unit includes an inlet line and an outlet line. In a typical installation, the high pressure line from the compressor carrying superheated refrigerant gas is connected to the inlet line of the heat transfer element and the outlet line is connected to the condenser input. For the usual vertical tank, it is preferable that the heat exchange element be in the form of an elongated outer tube closed at the lower end which will extend from the top of the tank to the bottom. The inlet line connects to an inner tube which is concentric with the closed tube and extends within a short distance of the closed end. Thus, the hot refrigerant gas flows down the inner tube and out of the lower end, thereafter rising in the annular space around the inner tube. The outlet line from the heat exchanger communicates with this annular space at the top end of the outer tube and conducts the hot gas to the condenser. The gas temperatures at the inlet line may be in the neighborhood of 180° to 200° F. in a typical air conditioning or refrigerating system. The superheat portion of the gas temperature may be on the order of 70° to 80° F. Thus, a significant portion of this superheat may be removed from the refrigerant gas by heat transfer through the outer tube of the heat exchanger into the water in the tank and the reduced temperature gas passed on to the condenser for condensation. Advantageously, the disposition of the heat exchange element in the storage tank having a portion near the top volume of water assists in quicker recovery of hot water by introducing heat over the full height of the tank. The refrigerant gas is circulated by virtue of the pressure from the compressor and no external pumps, valves, or controls are utilized.

To obviate the requirement for thermostatic valves and the like, a tempering valve is used between the hot water outlet like, a tempering valve is used between the hot water outlet from the water storage tank and the cold water inlet. If there is a minimum use of hot water, the temperature of the water in the tank may become greater than the normal desired temperatures of 140° to 150° F., in which case the tempering valve will mix cold water with hot water drawn from the tank to protect the user from excessive water temperatures. It is contemplated that the normal source of heat for the water tank will be utilized for heating the water in the tank when the refrigeration or air conditioning system is not in use.

In an alternative embodiment of the heat exchange element of the invention, the heat exchange element is constructed with the closed end tube having a double wall. The space between the double wall is filled with a heat transfer fluid such as silicone, and vented to the atmosphere. This construction complies with some building codes which require means to prevent contamination of consumable water supplies with freon or other contaminants.

As may now be seen, the invention provides a simple, low-cost system for utilizing the superheat of the refrigerant gas in an air conditioner or refrigeration system, which would otherwise be wasted, to heat water thereby providing significant energy conservation. The heat exchange element may be installed in domestic or commercial water heaters without modification thereto.

It is therefore a primary object of the invention to provide a system for utilizing waste heat from air conditioning and refrigeration systems for heating water without requiring extensive modification of existing water heater configurations.

It is another object of the invention to provide a heat exchange element for carrying superheated gas refrigerant which is adapted to be installed in a standard water heater without modification thereto.

It is yet another object of the invention to provide a heat exchange element having a heat transfer fluid therein to comply with anti-contamination codes.

It is still another object of the invention to provide a waste heat recovery system to be used in conjunction with air conditioning and refrigeration systems to utilize such waste heat for heating of water and which does not require valves, pumps, or control devices.

These and other objects and advantages of the invention will become apparent with reference to the detailed description below and the accompanying drawings.

DETAILED DESCRIPTION OF THE PREFERRED EMBODIMENT

Figure 1:
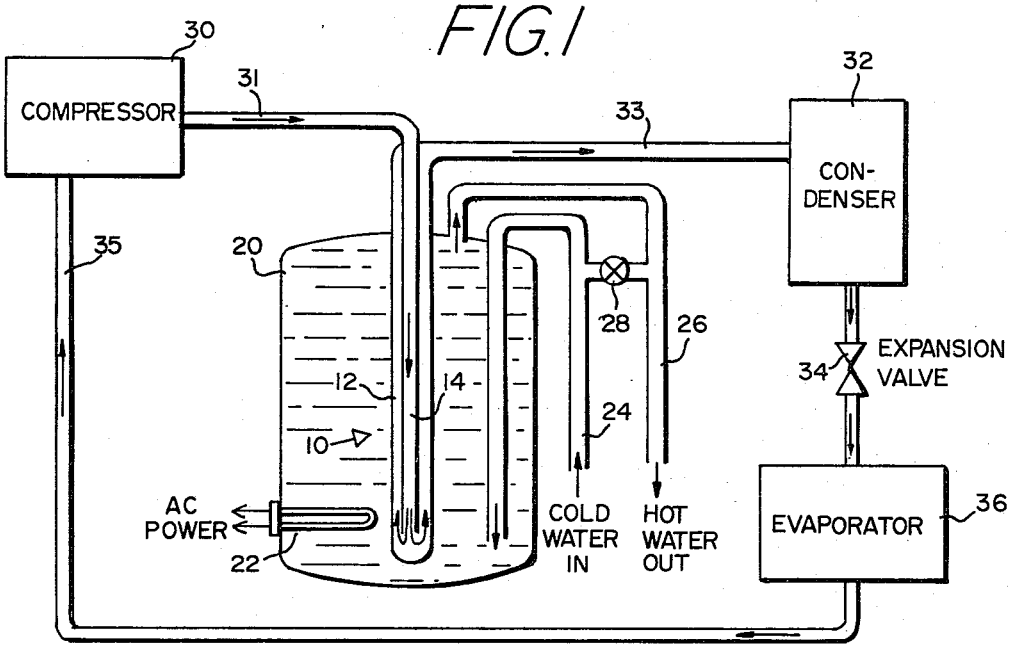
FIG. 1 is a schematic diagram of a hot water storage tank with the heat exchange unit of the invention installed therein and connected into a typical refrigeration system.

Referring to FIG. 1, a simplified schematic diagram is shown of a system in accordance with the invention. A conventional hot water storage tank 20 is shown such as may be used in residences and commercial establishments. The primary source of heat energy may be an electrical heating element 22, or such primary heat may be supplied from conventional oil or gas burners, or the like. Cold water inlet pipe 24 supplies water from the main water supply to tank 20 and hot water outlet pipe 26 supplies the heated water to the user as indicated by the flow arrows. A tempering valve 28 is connected between the cold water inlet pipe 24 and the hot water outlet pipe 26 as will be discussed in more detail hereinafter. In accordance with the invention a heat exchanger shown generally at 10 is disposed in water storage tank 20 and preferably extends to bottom thereof. Heat exchanger 10 may consist of a pair of concentric tubes having outer tube 12 closed at its lower end and connected to outlet line 33 at its upper end while inner tube 14 is open at the lower end thereof and is connected externally to inlet tube 31 at its upper end. Tube 31, heat exchanger 10 and outlet tube 33 represent a refrigerant line from a compressor 30 to a condenser 32 which are elements of an air conditioning or refrigeration system.

The operation of the invention as illustrated in FIG.1 will be described with references to the entropy and enthalpy diagrams of FIGS. 3 and 4. The schematic diagram of FIG. 1 has been simplified to show only the basic elements of the refrigeration system which in addition to compressor 30 and condenser 32 are expansion valve 34, evaporator 36 and line 35. Although the pressures and temperatures of the refrigerant in the refrigeration system at various points thereof will vary with the type of refrigerant, the application, and the efficiencies of the system, a typical set of values will be used for explanation.

Figure 3:
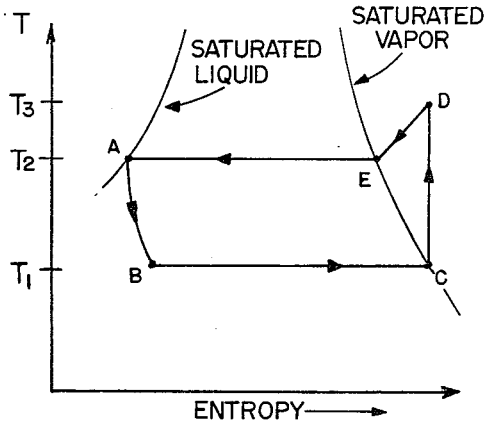
FIG. 3 is a temperature-entropy diagram for an idealized refrigeration system.
Figure 4:
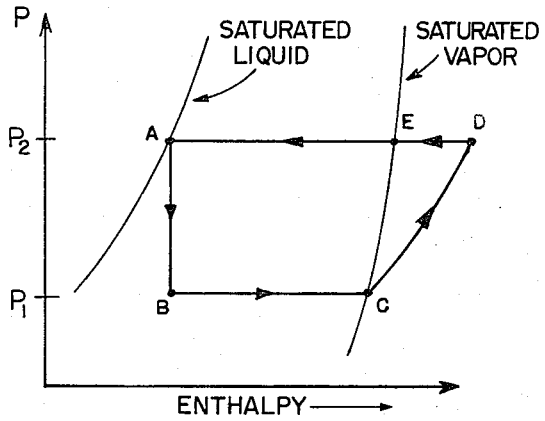
FIG. 4 is a pressure-enthalpy diagram for the refrigeration system of FIG. 3.

Referring first to point A on the state diagrams of FIG. 3 and FIG. 4, the refrigerant is in a saturated liquid state at the outlet of condenser 32 having a temperature of, for example, 120° F.($T_2$) and a pressure of, for example, 160 psi($P_2$). As the liquid refrigerant enters expansion valve 34, adiabatic expansion takes place with the pressure dropping to, for example, 65 psi($P_1$) at point B and the temperature dropping to, for example, 65° F.($T_1$). As the liquid expands it evaporates to the gaseous state and undergoes an isothermal expansion from point B to point C on the diagrams with an increase in heat content but at constant pressure and temperature. The vapor gas leaves evaporator 36 via line 35 to compressor 30, which causes the gas to undergo adiabatic compression from point C to point D, producing, for example, a temperature of 180° F.($T_3$) and a pressure of 160 psi($P_2$). Temperature $T_3$ of 180° represents superheated gas with respect to the saturation temperature of the vapor of 120° ($T_2$) at 160 psi. In the normal refrigeration system, the superheated gas is introduced into the condenser which must first remove the superheat before causing the gas to condense to the liquid state. This operation is represented by the change from point D to point E on the diagrams. In accordance with the invention, the superheated gas enters heat exchanger 10 via inlet line 31 and inner tube 14. As the gas flows, as shown by the flow arrows in FIG. 1, through the heat exchanger 10 out outlet line 33, heat flows through the outer wall 12 of heat exchanger10 into the cooler water in storage tank 20. A temperature differential of from 40° to 100° F. may exist between the superheated gas temperature and the water temperature. Thus, the heat exchanger 10 effectively produces work from the energy contained in the superheated gas from compressor 31 and the gas delivered to condenser 32 has therefore been significantly reduced in heat content. In additional to performing useful work in heating water, the system of the invention results in a higher efficiency of condenser 32 since less heat must be removed to reach the saturated liquid point A at 160 psi.

In the usual water heating systems, a thermostat is used in conjunction with a source of heat such as electrical heating element 22. Temperatures are commonly set in the range of 130° to 150° F. However, since the superheated gas in heat exchanger 10 may be in the range of 180° F., it may be noted that the water in storage tank 10 may become hotter than the main heating element thermostat setting requires, particularly when there is a low rate of hot water usage. For this reason, tempering valve 28 is provided and arranged to bleed cold water from inlet line 24 into hot water outlet line 26 when the temperature of the water in line 26 exceeds a desired upper limit. Advantageously, this method of control effectively increases the storage capacity of the system, since for a given volume of hot water at, for example 140° F., less heated water is drawn from tank 20. This method also greatly simplifies the refrigeration system by obviating the need for thermostats, pumps, or by-pass valves.

Figure 2:
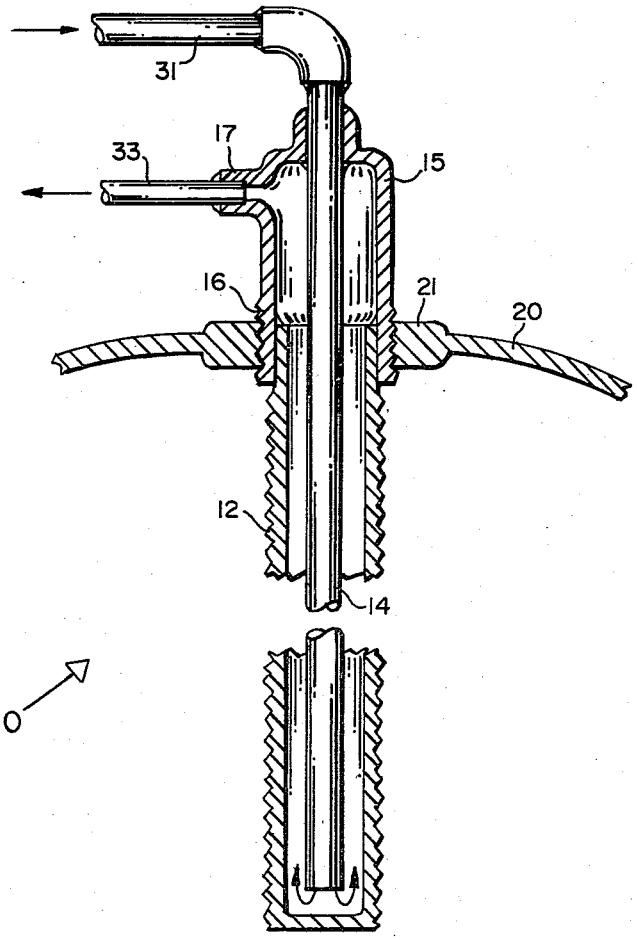
FIG. 2 is a cross-sectional view of the heat exchange unit of the invention installed in a storage tank.

Turning now to FIG. 2, construction details of the heat exchange unit 10 in accordance with the invention will be described. A cross-sectional view of heat exchanger 10 is shown installed in tank 20 shown in partial view. Outer tube 12 of heat exchanger 10 is selected to extend from the top of tank 20 essentially to the bottom thereof. Outer tube 12 may be threaded as illustrated in FIG. 2 to provide a larger heat transfer surface. Outlet chamber 15 is utilized for installing heat exchanger 10 in tank 20. As may be noted, outlet chamber 15 has pipe threads 16 at its lower end for threading into a boss 21 in tank 20. Outer tube 12 is inserted in the lower end of chamber 15 and brazed or welded thereto. Center tube 14 may be concentric with outer tube 12 and projects through the top end of outlet chamber 15, being welded or brazed thereto. A fitting 17 is also provided in outlet chamber 15 for connection to outlet pipe 33.

Figure 5:
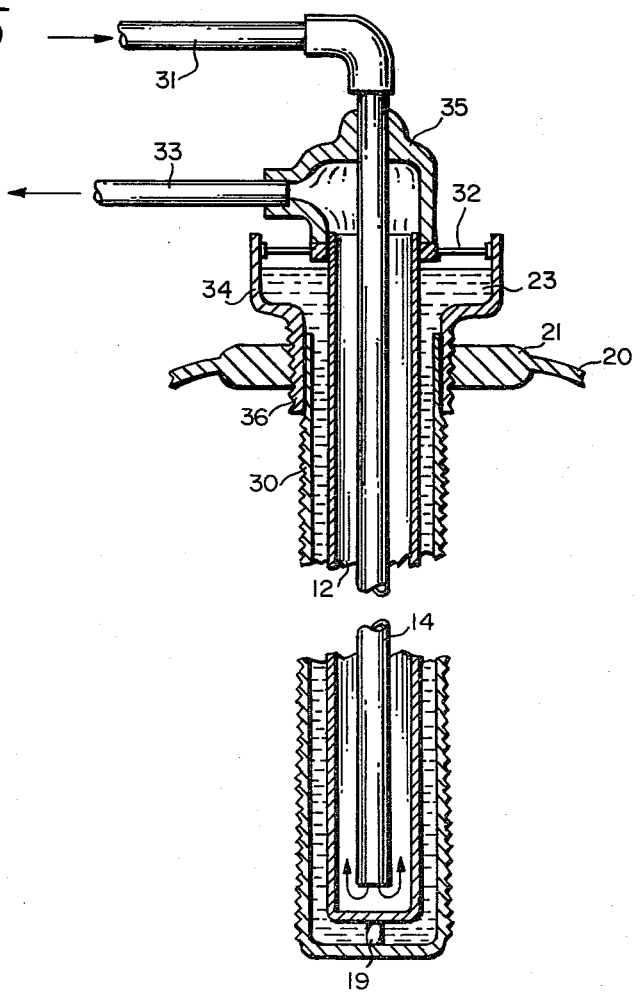
FIG. 5 is an alternative embodiment of the heat exchange unit of FIG. 2 having a safety heat transfer liquid.

Heat exchanger 10 is preferably fabricated from corrosion resistant metals having the necessary properties for direct contact with refrigerant gases and hot water. For example, extra heavy red brass pipe is a suitable material.

Where building or health codes require positive protection to prevent accidental contamination of domestic water supply from refrigerant fluids, an alternative construction of heat exchanger 10 may be used as shown in FIG. 5. Outside tube 12 represents the inner wall of a double wall heat exchange system. A reservoir 34 is provided having pipe threads 36 for threading into boss 21 of tank 20. Outer tube 30 is provided having a closed end, and an open end which is welded to reservoir 34. Heat exchanger 10 is supported in the well formed by reservoir 34 and outer tube 30 by a spider assembly 32 at the upper end and a post 19 at the lower end. The spider assembly may include a screen or the like to prevent debris and insects from contaminating the transfer liquid 23 in reservoir 34. The space in the double wall formed betweeen tube 12 and outer tube 30, as well as reservoir 34, is filled with a heat transfer liquid 23. While various liquids may be used, a silicon fluid is preferred which may be a silicon heat transfer fluid STLTHER 444 available from Dow Chemical. As may be noted, a failure of either tube 30 or tube 12 may occur without contamination of the water in tank 20 from the refrigerant.

Figure 6:
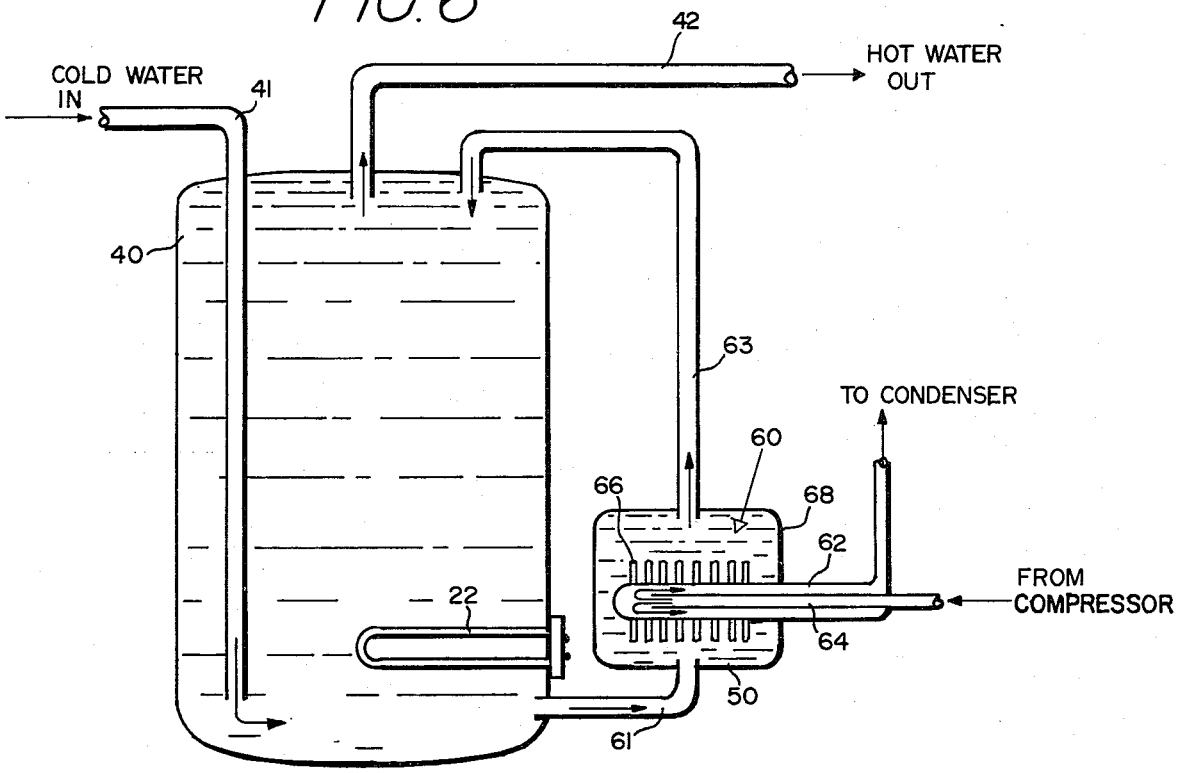
FIG. 6 is an alternative arrangement of the invention utilizing a side arm type element in conjunction with the heat exchange unit.

An alternative embodiment of the invention is shown in FIG. 6 which utilizes a side arm type heating system. A small auxiliary tank 68 is coupled to the lower portion of a water storage tank 40 by line 61 and to the top of tank 40 by line 63. Heat exchanger 60 is inserted in tank 68 and connected to the refrigeration system as previously described with reference to FIG. 1. An increased heat transfer surface of heat exchanger 60 may be provided by means of radial fins 66 on outer tube 62. In operation, the water in tank 68, due to its small volume, will rise in temperature quickly toward the temperature of the superheated gas in heat exchanger 60 from the compressor via line 69 and inner tube 64. The heated water will tend to rise in line 63 as indicated by the flow arrow, and to be replaced by cooler water from the lower portion of the tank via line 61. Thus, as long as temperature differentials between the water in tank 68 and in main storage tank 40 exist, this circulation will take place. This alternative embodiment may be used in existing installations in which access to existing tank fittings and connections may be inconvenient.

Figure 7:
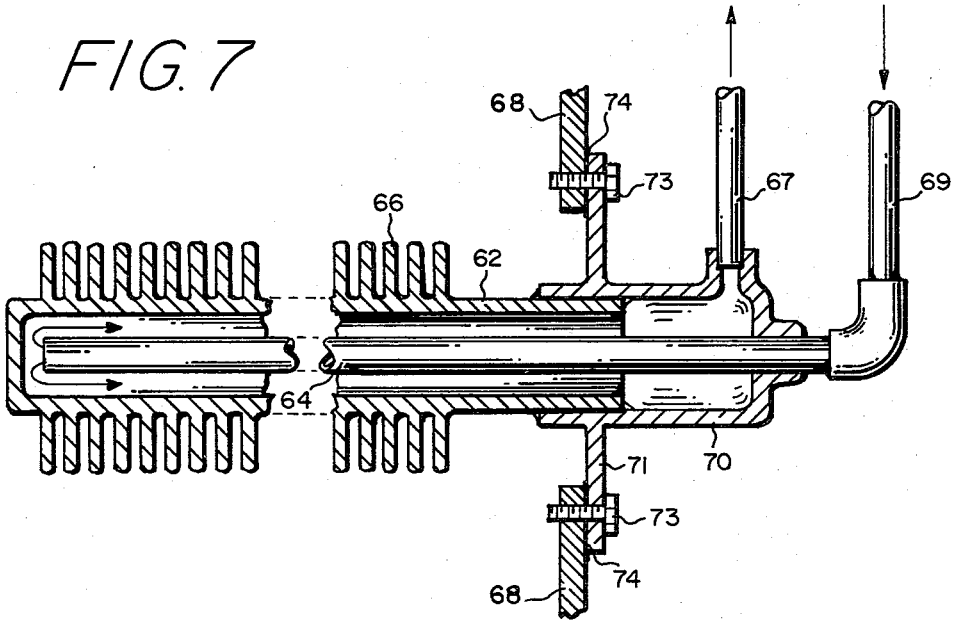
FIG. 7 is a cross-sectional view of the heat exchange unit of FIG. 6 showing its finned construction.

FIG. 7 is a cross-sectional view of a typical construction for the heat exchanger 60 of FIG. 6. The construction is similar to heat exchanger 10 of FIG. 2 but generally of much shorter length. Fins 66 provide greater heat transfer area to compensate for the shorter length. To provide clearance for fins 66 when installing heat exchanger 60 in tank 68, a flange 71 is provided on chamber 70 and is attached to tank 68 by means of bolts 73 and gasket 74. Heat exchanger 60 may also be used directly in a water storage tank designed for multiple electrical heating elements by selecting flange 71 to match the electrical heating element flange. Where building codes require, the heat exchanger construction disclosed above with reference to FIG. 5 may be used with heat exchanger 60.

As may now be recognized, the energy conservation system for heating water with waste heat from a refrigeration or air conditioning system in accordance with the invention may be installed in an existing water heating system and refrigeration system with a minimum of alterations. The heat exchanger in accordance with the invention is adapted to fit a standard threaded boss in a conventional hot water storage tank and to connect to the refrigeration system without additional devices such as pumps, valves, thermostats, or the like. The system therefore provides useful work from otherwise wasted energy and improves the efficiency of the hot water heating system by reducing requirement for primary heat input, and increases the efficiency of the air conditioning or refrigeration system by removing superheat from the refrigerant in its superheated vapor state prior to condensing.

Although certain specific methods of installation of the elements of the invention and of the construction of those elements have been shown for exemplary purposes, it is obvious to one skilled in the art that many variations and modifications may be made therein without departing from the spirit or the scope of the invention.

I claim:

1. A water heating system utilizing waste heat from a refrigeration system comprising:

a water storage tank having a cold water inlet line and a hot water outlet line, said water storage tank having a boss having a threaded opening therethrough;

a heat exchange unit disposed in said water storage tank and having an inlet port for connecting to the outlet of the compressor of said refrigeration system and an outlet port for connecting to the inlet of the condenser of said refrigeration system, said heat exchange unit having a threaded portion thereof adapted to match said threaded opening in said water storage tank for installation of said heat exchange unit in said water storage tank;

means for controlling the temperature of water issuing from said hot water outlet line to be below a predetermined temperature; and said heat exchange unit comprising:

an outlet chamber attached to said threaded portion;

an elongate outer tube having a closed end and an open end thereof, said open end of said outer tube communicating with said outlet port via said outlet chamber; and an elongate inner tube disposed within said outer tube, said inner tube having a first open end adjacent said closed end of said outer tube, and a second open end communicating with said inlet port.

2. A water heating system utilizing waste heat from a refrigeration system in accordance with claim 1, in which the outer surface of said elongated outer tube has a heat transfer surface formed thereon to increase the surface area of said outer surface to provide an increased heat transfer.

3. A water heating system utilizing waste heat from a refrigeration system in accordance with claim 1, in which said means for controlling the temperature of water issuing from said hot water outlet line is a tempering valve bleeding water from said cold water inlet line into said hot water outlet line in proportion to the temperature of the hot water in the outlet line to adjust the temperature of the hot water in the outlet line to below a predetermined temperature.

4. A heat exchanger for use in heating consumable water by transferring heat from a refrigerant in its vapor state to said consumable water comprising:

an elongate double walled tube having a closed end and an open end, said open end including a first open portion communicating with the interior space of said double walled tube, and a second open portion communicating with the central inside portion of said double walled tube;

said second open portion adapted to be connected to a refrigeration system compressor and a refrigeration system condenser so as to circulate superheated refrigerant flowing from said compressor via the central inside portion of said double walled tube to said condenser;

reservoir means communicating with said first open portion of said double walled tube, said reservoir open to the atmosphere;

heat transfer liquid disposed in said reservoir and said interior space in said double walled tube; and mounting means associated with said double walled tube for mounting heat exchanger in an existing water storage tank to place said double walled tube in a heat exchange relationship between said superheated vapor in said central inside portion and said consumable water in said storage tank.

5. The heat exchanger in accordance with claim 4, in which said reservoir means has an elongated tube having said elongated double tube mounted thereinside, and having an exterior surface formed to increase the heat exchange area between said reservoir means and said consumable water in said storage tank.

6. The heat exchanger in accordance with claim 5, in which said mounting means includes a threaded portion on said reservoir means elongated tube for attaching to an existing internally threaded inlet to a hot water storage tank.

* * * * *